United States Patent [19]

Luzier

[11] Patent Number: 4,745,801

[45] Date of Patent: May 24, 1988

[54] GROUNDWATER SAMPLING SYSTEM

[76] Inventor: James E. Luzier, 2 Gershwin Ct., Lake Oswego, Oreg. 97034

[21] Appl. No.: 870,071

[22] Filed: Jun. 3, 1986

[51] Int. Cl.[4] ..... E21B 49/08

[52] U.S. Cl. ..... 73/155; 73/863.24; 166/264

[58] Field of Search ..... 73/155, 151, 73, 38, 73/863.23, 863.24, 863.31, 864.34, 864.63; 166/264

[56] References Cited

U.S. PATENT DOCUMENTS

| | | | |
|---|---|---|---|
| 2,605,637 | 8/1952 | Rhoades | 73/151 |
| 3,240,067 | 3/1966 | Jongejan | 73/863.23 |
| 3,930,754 | 1/1976 | Mogg et al. | 73/155 X |
| 4,015,479 | 4/1977 | Apple | 73/863.24 |
| 4,112,768 | 9/1978 | Holland et al. | 73/863.24 |
| 4,192,181 | 3/1980 | Patton et al. | 73/155 |
| 4,548,266 | 10/1985 | Burklund | 166/264 X |
| 4,585,060 | 4/1986 | Bernardin et al. | 73/864.34 X |

FOREIGN PATENT DOCUMENTS

| | | | |
|---|---|---|---|
| 2101234 | 8/1972 | Fed. Rep. of Germany | 73/863.23 |
| 0578583 | 10/1977 | U.S.S.R. | 73/155 |

*Primary Examiner*—Stewart J. Levy
*Assistant Examiner*—Kevin D. O'Shea
*Attorney, Agent, or Firm*—Olson and Olson

[57] ABSTRACT

A multi-level groundwater sampling system utilizes a multiplicity of small diameter flexible sampling tubes terminating at their lower ends at different depths in a single small diameter drill hole, the lower end section of each sampling tube being perforated and loosely wrapped with fine mesh flexible cloth screen secured to the perforated tube section by longitudinally spaced ties, so that the cloth may flex inward and outward to assist in removing potential screen-plugging silt or other finely particulate solids. The upper ends of the sampling tubes are available for connection to a vacuum pump for collection of groundwater samples. The upper ends of the sampling tubes also may be coupled to a manifold connected to a vacuum pump for measuring groundwater pressures.

16 Claims, 2 Drawing Sheets

GROUNDWATER SAMPLING SYSTEM

BACKGROUND OF THE INVENTION

This invention relates to geohydrology studies, and more particularly to a system by which to obtain a multitude of groundwater samples at a multitude of precise elevations below ground level for selective chemical analyses, water temperature and pressure measurements, in a minimum of time and at a minimum of cost.

Groundwater sampling systems provided heretofore generally utilize individual or nested groups of one to seven rigid steel or plastic pipes of 2.5 to 5 centimeters inside diameter, each with a bottom pipe section perforated over a length of 1 to 12 meters, and obtaining groundwater samples therefrom by the manual and time consuming use of bailers, or powered pumps inserted deeply into the pipe. The rigid pipes are installed in the ground by the provision of drill holes of desired depth, and the bottom perforated section of each pipe is terminated at a different depth.

Because of drill hole entry size limitations and escalating costs with increasing drill hole size, most nested groups of sampling wells are formed of individual, closely adjacent drill holes of about 15 to 25 centimeters in diameter, drilled to different depths, with each containing a single 5 centimeter diameter perforated pipe. Occasionally, a single 15 centimeter drill hole is provided with two or three perforated rigid pipes of about 3 centimeters in diameter. More rarely, a 25 centimeter diameter drill hole may be provided with up to seven 2.5 centimeter perforated pipes.

Prior art groundwater sampling systems are disclosed in Construction Dewatering—A Guide To Theory And Practice, by J. Patrick Powers, P. E., Published 1981 by John Wiley and Sons, Inc., pages 133–136 and 271–275, and in Groundwater Monitoring Review, Spring 1986, Volume 6, No. 2, Published by Water Well Journal Publishing Company, generally through pages 50–72 and many advertisements throughout the Volume, and in particular the article on pages 50–55 entitled Multiple Completion Monitor Wells, by Dennis B. Nakamoto et al.

The foregoing systems of the prior art have many serious limitations and disadvantages: They require the removal of large volumes (4 to 10 pipe volumes) of stagnant and usually contaminated fluid prior to groundwater measurement in order to insure representative, fresh chemical sampling of the porous medium. Cross-contamination from pipe-to-pipe is common because bailers and pumping equipment are difficult to clean after each use. The perforated sections of pipe are subject to irreversible clogging of the rigid perforations by earth formation particles and naturally precipitated mineral cements. They are more subject to leakage because of the multiplicity of pipe joints and metal corrosion, and to breakage during installation or long term earth movements. They do not provide sufficient precision in mapping chemical and pressure variations in a porous medium, at reasonable cost. And they do not allow simultaneous and rapid measurements of fluid pressure change during formation pump tests without sophisticated recording devices or extra manpower.

Structurally complex large diameter ported rigid pipe assemblies also are available at very high cost. Examples of components thereof are disclosed in U.S. Pat. Nos. 4,192,181; 4,204,426; 4,230,180; 4,254,832; and 4,258,788. These assemblies are subject to many of the limitations and disadvantages of the conventional systems described hereinbefore.

SUMMARY OF THE INVENTION

In its basic concept, this invention provides a groundwater sampling system in which a multiplicity of small diameter flexible sampling tubes are extended downward through a small diameter drill hole and embedded naturally in a formation to a multiplicity of depths, the bottom end of each tube terminating in a short perforated length overlaid with one or more loose wrappings of fine mesh, flexible cloth screen secured in place with a plurality of longitudinally spaced encircling retainers.

It is by virtue of the foregoing basic concept that the principle objective of this invention is achieved: namely, to overcome the aforementioned limitations and disadvantages of prior groundwater sampling systems.

Another objective of this invention is to provide a groundwater sampling system of the class described which affords precise samplings at any desired number of depths.

Still another objective of this invention is the provision of a groundwater sampling system of the class described which has a long service life.

A further objective of this invention is to provide a groundwater sampling system of the class described in which the screened perforated section is readily maintained free of clogging and hence in optimum operating condition over the long service life of the system.

A still further objective of this invention is the provision of a groundwater sampling system of the class described which is of simplified construction for economical manufacture, installation and maintenance.

The foregoing and other objects and advantages of this invention will appear from the following detailed description, taken in connection with the accompanying drawings of preferred embodiments.

DESCRIPTION OF THE PREFERRED EMBODIMENTS

Figure 1:
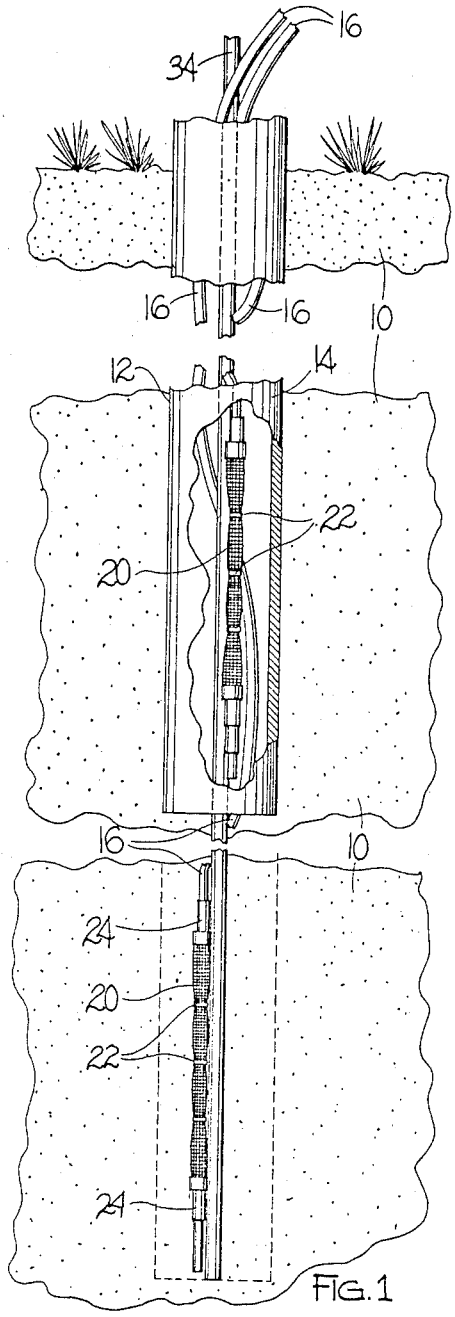
FIG. 1 is a framentary, foreshortened vertical elevation of a drill hole having installed therein a groundwater sampling system embodying the features of this invention, portions being broken away to disclose structural details.

FIG. 1 illustrates a vertical section of earth 10 in which has been produced a drill hole 12 into which has been fitted a casing tubing 14 of diameter and depth corresponding to the drill hole. For example, it is conventional for groundwater sampling systems to extend into the earth from 3 to more than 60 meters, and in accordance with this invention the inside diameter of the drill hole and hence the casing tubing ranges between 7 and 15 centimeters. FIG. 1 also shows the casing tubing partially retracted, as explained more fully hereinafter.

A multiplicity of small diameter flexible sampling tubes 16 are extended downwardly in the casing tubing to a multiplicity of different depths. The number of tubes may range from two to more than 40, as required. As a typical illustration, twenty such sampling tubes may be contained within the casing tubing, terminating about 3 meters apart throughout a depth of about 60 meters. The sampling tubes may range in diameter from about 4 millimeters to about 13 millimeters, preferably about 6 millimeters. The sampling tubes are made of flexible synthetic resin, such as polyvinyl chloride or other suitable substantially inert resin. A preferred material is Teflon for its low coefficient of friction and its inertness and consequent inability to contaminate or absorb the groundwater sample delivered through it.

Each sampling tube 16 has a lower terminal section 16' provided with a multiplicity of openings 18 for the entrance of groundwater at the corresponding depth of the tube. As illustrated, the lower section 16' is integral with the long, upper length of tube. However, it may be formed as a separate section secured to the upper long section 16 as by means of a tight fitting compression coupling or tubing connector.

The perforated section 16' is overlaid with a loose wrapping of fine mesh, flexible cloth screen 20, preferably of stainless steel or other flexible material that does not contaminate the groundwater sample. The purpose of the screen is to prevent silt and other finely particulate solids material from entering the sampling tube. Suitable screen material may range from about 30 to over 150 mesh. About 60 mesh is quite suitable for most applications.

Further, a single wrap of cloth screen about the perforated section 16' is operable for purposes of this invention, but multiple wraps, preferably three, is preferred for maximum efficiency of screening and screen movement, as discussed hereinafter.

The loose screen wrapping is secured about the perforated tube section 16' by any suitable means. In the embodiment illustrated, there is provided a plurality of longitudinally spaced ties 22 preferably of flexible plastic or other suitable material that will not contaminate the groundwater samples. By way of illustration, with a perforated tube section of about 30 centimeters in length, screen wrapping ties may be spaced apart between 3 and 10 centimeters, preferably about 5 centimeters. The opposite ends of the screen wrapping are covered by non-contaminating heat shrink tubings 24.

The spaced ties 22 provide loose wrappings of cloth screen between them, allowing the screen to flex, or "squirm" toward and away from the perforated tube section 16' both during the collection of groundwater samples and a back-flushing operation, to be described hereinafter.

Figure 2:
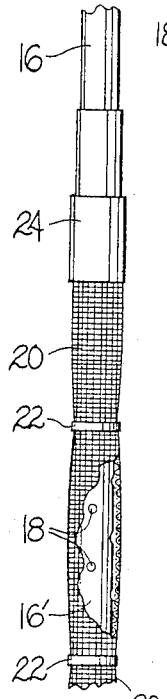
FIG. 2 is a fragmentary, foreshortened plan view of the screened terminal section of one of the sampling tubes of FIG. 1, on an enlarged scale.
Figure 2:
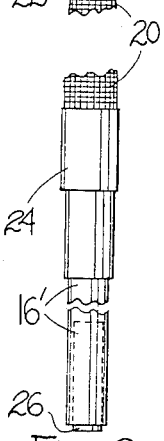
Figure 3:
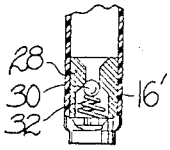
FIG. 3 is a fragmentary plan view of a modified form of closure for the terminal section of FIG. 2.
Figure 4:
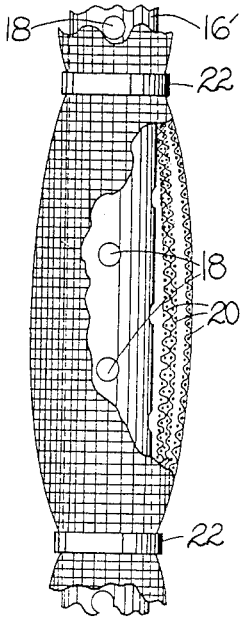
FIG. 4 is a fragmentary plan view, on an enlarged scale, of a portion of the screened terminal section, showing the screen in distended condition resulting from high pressure back-flushing to dislodge potential screen-plugging material.
Figure 5:
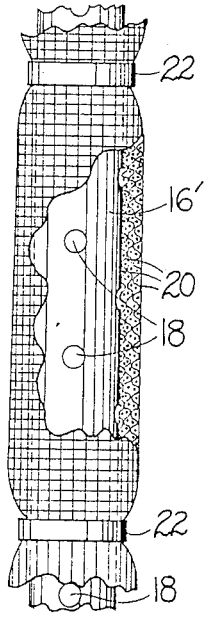
FIG. 5 is a fragmentary plan view similar to FIG. 4, showing the screen in collapsed condition resulting from the flow of groundwater inwardly through the screen to the interior of the sampling tube for elevation to a sampling station at ground level.

The bottom end portion of the perforated tube section 16', preferably about 10 centimeters long, serves as a sediment trap and is closed at the bottom to prevent the entrance of silt and other debris. In FIG. 2 the closure is provided by a tightly inserted simple plug 26. In FIG. 3 the closure is provided by a check valve having a body 28 containing a ball check 30 and a spring 32. The spring allows opening of the ball check valve when a back-flushing pressure is applied to the tube to clear the screen of potential plugging material. Opening of the ball check allows any silt and other sediment accumulation in the bottom end of the tube section 16 to be expelled therefrom. The ball check valve unit is attached to the perforated tube section 16' by a compression fitting or tubing connector.

Installation of the groundwater sampling system described hereinbefore in a test area proceeds as follows: A drill hole 12 of suitable diameter and depth is produced and a casing tubing 14 installed. An elongated support rod 34 (FIGS. 1 and 6) of solid cross section or in the form of hollow tubing, preferably about 1.25 centimeters in diameter, is assembled by interconnecting about 3 meter lengths with threaded couplings, as sampling tubes 16 are secured frictionally thereto, as by means of flexible plastic ties 36, and lowered into the casing tubing. Additional lengths of support rod are connected as the depth increases and additional tubings are secured thereto. For example, twenty sampling tubes may be tied at longitudinally spaced intervals to the support rod, with the screened sections 16' spaced apart about 3 meters, to provide a groundwater sampling system about 60 meters in length. The rod may be removed for re-use, if desired.

Figure 6:
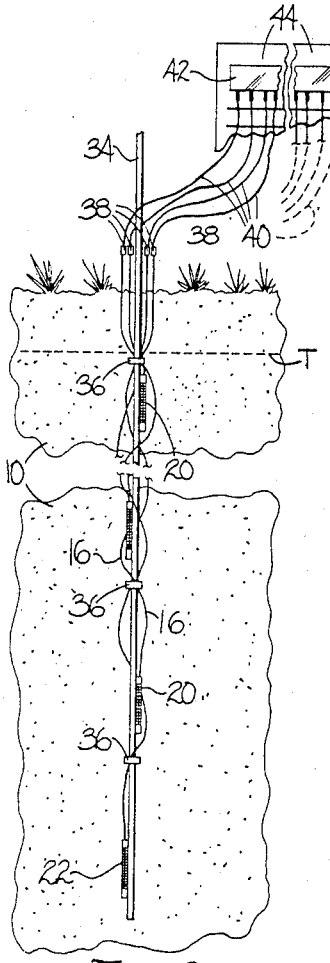
FIG. 6 is a fragmentary, foreshortened vertical elevation of an installation of the system of FIG. 1 coupled to apparatus for measuring groundwater pressures at diverse depths.

After the assembly of sampling tubes has been installed in the casing tubing, the latter is then withdrawn, as illustrated in FIG. 1, allowing the soil formation to collapse about the sampling tubes and lock them in place, as illustrated in FIG. 6. If necessary, backfill material, such as bentonite clay seal, or sand, may be added at longitudinally spaced intervals between screened sections, in manner well known in the art.

Alternatively, the drill hole 12 may be produced by a hollow stem auger drill and the sampling tubes 16 with support rod 34 lowered through the hollow stem to desired depth. Upon retraction of the auger the soil formation collapses about the supported sampling tube assembly.

The upper end of each sampling tube 16 is available for the usual variety of chemical and physical groundwater measurements. These include temperature, pressure, electrical conductance, dissolved oxygen and other gases, and the chemical analyses of elements, ions and organic compounds as groundwater contaminants or naturally occurring substances. Such sampling is accomplished by connecting a desired sampling tube 16 to a vacuum pump, preferably of the peristaltic type. The high vacuum efficiency and pulsating pressure variations of this type of pump causes alternate inward and outward flexing of the cloth screen wraps 20 to minimize the collection of solid particles or solid blockage thereon. Groundwater samples delivered from the pump may be subjected to conventional testing.

Figure 8:
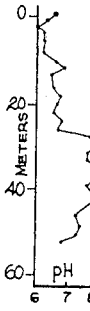
FIG. 8 is a graph exemplifying measured pH changes throughout the depth of a sampling system such as is illustrated in FIG. 6.
Figure 9:
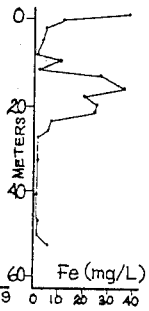
FIG. 9 is a graph exemplifying measured dissolved ferrous iron concentrations throughout the depth of a sampling system such as is illustrated in FIG. 6.
Figure 10:
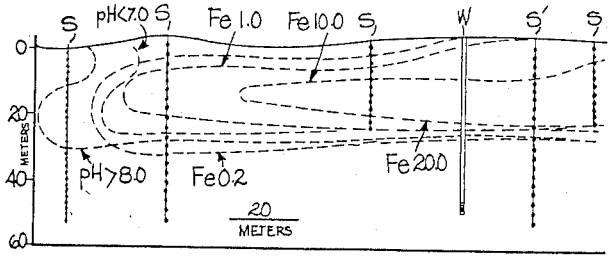
FIG. 10 is a graphic representation of a geohydrology cross section showing a contoured pattern of the pH and ferrous iron concentrations at laterally spaced sampling systems as exemplified by the data plots of FIGS. 8 and 9 taken at sampling station S' from diverse depths determined by a plurality of sampling systems of this invention.

Test results may be plotted to provide visual graphs representations, such as the pH and ferrous iron graphs shown in FIGS. 8 and 9. Further, these test results may be used to prepare graphic representations of the geohydrology cross section of the test site, as shown in FIG. 10. Such a complete plot is possible because of the ability of a plurality of systems S of this invention to retrieve groundwater samples at a multiplicity of depths in each of a plurality of laterally spaced small diameter drill holes, quickly and at reasonable cost.

On the other hand, such a complete plot is not economically feasible with sampling systems of the prior art, since it would involve the excessive costs of a large number of large diameter drill holes and associated rigid pipes, as well as the excessive time and cost of hand sampling by the use of bailers or expensive pumping apparatus.

Figure 7:
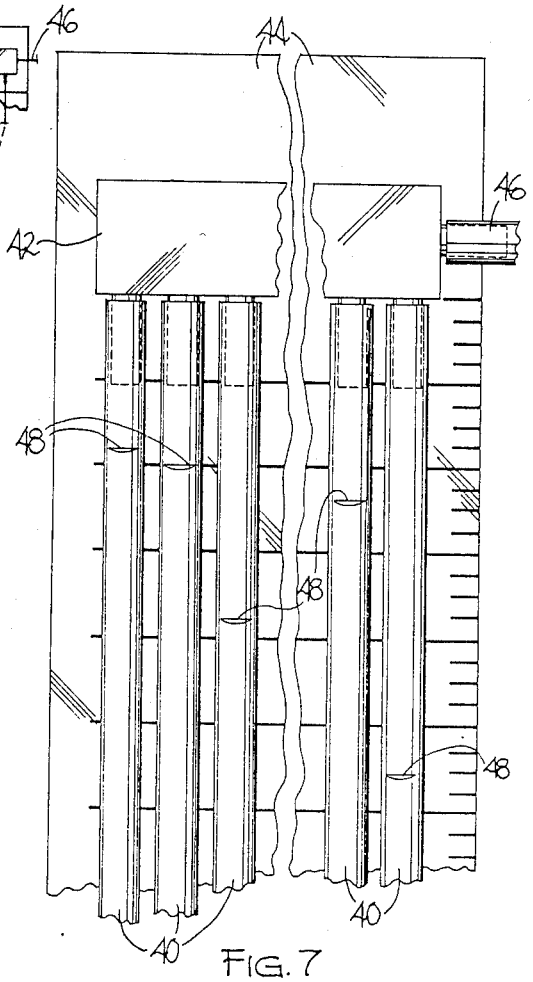
FIG. 7 is a fragmentary, foreshortened vertical elevation of the pressure measuring component of the assembly of FIG. 6, on an enlarged scale.

FIGS. 6 and 7 illustrate the groundwater sampling system of this invention associated with means for visually observing and measuring groundwater pressures at diverse depths below the water table T. As shown, all of the sampling tubes in one drill hole are coupled by connectors 38 and transparent or translucent sample measuring tubes 40 to a common manifold 42. The manifold is supported by panel 44 and connected through a vacuum tube 46 to a vacuum pump. Since the exposed lengths of sample measuring tubes 40 adjacent the manifold are transparent or translucent, the upper, elevated meniscus levels 48 of water samples in the tubes are visible to an operator. These meniscus levels may be made more visible, if necessary, by adding coloring material to the water. Each elevated meniscus may be referenced to a common elevation, such as sea level, by initial measurement of the natural water table in a single tube, by conventional technology.

The operator may record the meniscus levels by any of various suitable means. For example, the levels may be marked on the sampling tubes by colored markings, or on a paper or plastic background supported by the panel 44 which mounts the manifold. Alternatively, the paper or plastic background may be provided with appropriate graduations, as illustrated, and the meniscus levels recorded photographically.

A series of such recordings at predetermined rapid time intervals helps establish by scientific analysis the direction and rate of migration of groundwater at a multiplicity of depths and laterally spaced positions relative to a physical condition, such as is imposed by a nearby pumping production well W, shown in FIG. 10. Combined with the precision profiles of groundwater chemistry, there is afforded means for determining the extent and direction of contaminant of plume migration and for designing wells to avoid it or remove it.

It will be apparent to those skilled in the art that various changes may be made in the size, shape, type, number and arrangement of parts described hereinbefore. For example, the sampling system may be used to monitor contaminant fluid and gas migration at land fill sites, by disposing a plurality of sampling tubes 16 horizontally over the bottom of the site during its construction, with the outer, open ends of the tubes gathered together in proximity to a sample collection station. This and other modifications may be made without departing from the spirit of this invention and the scope of the appended claims.

Having now described my invention and the manner in which it may be used, I claim:

1. A groundwater sampling system, comprising:

(a) a plurality of elongated small diameter flexible sampling tubes each having inner and outer ends and with the inner ends of the tubes arranged to extend into a test site and terminate at said inner ends at different locations, (b) a section of the inner end of each sampling tube being perforated, and (c) fine mesh flexible cloth screen material secured to and loosely encircling said perforated section to allow flexing of the screen material toward and away from the sampling tube, to minimize collection of solid materials on the screen material, the outer end of each sampling tube being exposed outwardly of the test site for collection of groundwater samples therefrom.

2. The groundwater sampling system of claim 1 wherein the flexible cloth screen material loosely encircles the perforated section of sampling tube and is secured thereto by a plurality of longitudinally spaced encircling retainers.

3. The groundwater sampling system of claim 1 wherein the flexible cloth screen includes a plurality of wraps loosely encircling the perforated section of sampling tube.

4. The groundwater sampling system of claim 1 including a check valve in the inner end of each sampling tube inwardly of the perforated section and operable to open at elevated pressure to allow expulsion of solids from the interior of the perforated section.

5. The groundwater sampling system of claim 1 wherein the sampling tubes extend vertically downward from ground level and terminate at their lower ends at different depths, the upper end of each tube being exposed for connection to a pump for collection of groundwater samples therefrom.

6. The groundwater sampling system of claim 5 wherein the pump is of the peristaltic type.

7. The groundwater sampling system of claim 5 wherein the mesh size of the cloth screen ranges between about 30 and 150.

8. The groundwater sampling system of claim 5 wherein the mesh size of the cloth screen is about 60.

9. The groundwater sampling system of claim 5 wherein the flexible cloth screen includes a plurality of wraps loosely encircling the perforated section of sampling tube.

10. The groundwater sampling system of claim 5 wherein the flexible cloth screen material loosely encircles the perforated section of sampling tube and is secured thereto by a plurality of longitudinally spaced encircling retainers.

11. The groundwater sampling system of claim 5 including a check valve in the inner end of each sampling tube inwardly of the perforated section and operable to open at elevated pressure to allow expulsion of solids from the interior of the perforated section.

12. The groundwater sampling system of claim 5 including a manifold arranged to couple the outer ends of the sampling tubes to a source of vacuum for measuring the groundwater pressure in the sampling tubes.

13. The groundwater sampling system of claim 5 wherein the sampling tubes initially extend vertically downward in a drill hole having a diameter ranging between about 7 and 15 centimeters, the sampling tubes having a diameter ranging between about 4 and 13 millimeters.

14. The groundwater sampling system of claim 13 wherein the diameter of the drill hole is about 10 centimeters and the diameter of each sampling tube is about 5 millimeters.

15. The groundwater sampling system of claim 13 wherein the number of sampling tubes in the drill hole ranges between 2 and 40.

16. The groundwater sampling system of claim 13 wherein the drill hole extends vertically downward from ground level, the mesh size of the cloth screen material is about 60, the flexible cloth screen material includes a plurality of wraps loosely encircling the perforated section of sampling tube and is secured thereto by a plurality of longitudinally spaced encircling ties, and the pump is of the peristaltic type.

* * * * *